US011566542B2

(12) United States Patent
Wang et al.

(10) Patent No.: US 11,566,542 B2
(45) Date of Patent: Jan. 31, 2023

(54) 660MW SUPERCRITICAL UNIT BYPASS CONTROL SYSTEM AND CONTROL METHOD THEREOF

(71) Applicant: CHINA ENERGY ENGINEERING GROUP EAST CHINA ELECTRIC POWER TEST RESEARCH INSTITUTE CO., LTD., Hangzhou (CN)

(72) Inventors: Meng Wang, Hangzhou (CN); Fei Li, Hangzhou (CN); Yanyun Lai, Hangzhou (CN); Hailong Qian, Hangzhou (CN); Jinliang Wang, Hangzhou (CN); Tao Wang, Hangzhou (CN)

(73) Assignee: CHINA ENERGY ENGINEERING GROUP EAST CHINA ELECTRIC POWER TEST RESEARCH INSTITUTE CO., LTD., Hangzhou (CN)

( * ) Notice: Subject to any disclaimer, the term of this patent is extended or adjusted under 35 U.S.C. 154(b) by 0 days.

(21) Appl. No.: 17/352,381

(22) Filed: Jun. 21, 2021

(65) Prior Publication Data

US 2021/0404349 A1 Dec. 30, 2021

(30) Foreign Application Priority Data

Jun. 24, 2020 (CN) ..... 202010590380.4

(51) Int. Cl.
*F01K 13/02* (2006.01)
*F01D 17/08* (2006.01)
(Continued)

(52) U.S. Cl.
CPC ..... *F01K 13/02* (2013.01); *F01D 17/085* (2013.01); *F01K 7/165* (2013.01); *F01K 11/02* (2013.01); *F01K 21/00* (2013.01)

(58) Field of Classification Search
CPC ..... F01K 13/02; F01K 21/00; F01K 11/02; F01K 7/165; F01D 17/085
(Continued)

(56) References Cited

U.S. PATENT DOCUMENTS 4,862,692 A * 9/1989 Fukuda ..... F01K 7/32 60/670
6,339,926 B1 * 1/2002 Ichiro ..... F01K 23/108 60/39.182

(Continued)

*Primary Examiner* — Hoang M Nguyen
(74) *Attorney, Agent, or Firm* — Bayramoglu Law Offices LLC

(57) ABSTRACT

A 660MW supercritical unit bypass control method after a load rejection is provided. Steam channels after the load rejection are switched without an interference, and ache steam pressure is controllable. The 660MW supercritical unit bypass control method includes Pipeline 1, Pipeline 2, Pipeline 3, and Pipeline 4; a bottom of Pipeline 3, a bottom of the Pipeline 2, and a head of the Pipeline 4 are connected by a temperature and pressure reducer; a bottom of the Pipeline 1 is connected to a head of Pipeline 2; a branch pipe is arranged between the Pipeline 1 and the Pipeline 2, and a steam turbine is arranged in the branch pipe. A high-pressure bypass control system automatically adapts to the load rejection or FCB under any loading situation, avoids drastic changes of unit parameters from loading fluctuations, meets requirements of the load rejection and the FCB.

5 Claims, 5 Drawing Sheets

(51) Int. Cl.
*F01K 7/16* (2006.01)
*F01K 11/02* (2006.01)
*F01K 21/00* (2006.01)

(58) Field of Classification Search
USPC ..... 60/645, 653, 660, 670
See application file for complete search history.

(56) References Cited

U.S. PATENT DOCUMENTS

| | | | | |
|---|---|---|---|---|
| 2019/0353055 | A1* | 11/2019 | Nishikawa | F01D 11/04 |
| 2020/0032676 | A1* | 1/2020 | Nose | F02C 6/18 |
| 2021/0246809 | A1* | 8/2021 | Fujimura | F01D 19/00 |

* cited by examiner

660MW SUPERCRITICAL UNIT BYPASS CONTROL SYSTEM AND CONTROL METHOD THEREOF

CROSS REFERENCE TO THE RELATED APPLICATIONS

This application is based upon and claims priority to Chinese Patent Application No. 202010590380.4 filed on Jun. 24, 2020, the entire contents of which are incorporated herein by reference.

TECHNICAL FIELD

The present invention relates to a bypass control system, specifically to a 660MW supercritical unit and a control method thereof.

BACKGROUND

When a supercritical unit is under the FCB or load rejection, the unit is disconnected from the external network, and the steam turbine valve is closed. In order to maintain the safety and stability of the unit and avoid blockage of the main steam pipe, it is necessary to open a high-pressure bypass to release a large amount of superheated steam to maintain the working fluid balance of the whole unit. The opening degree of the high-pressure bypass after load rejection is critical: while the opening degree is too large, the majority of the energy will be lost, which leads to economic loss to the normal unit operation; while the opening is too small, the steam flow will be blocked, which affects the unit safety. After the high-pressure bypass opens, it is necessary to continually adjust the pressure to avoid large fluctuations in steam pressure. The target value for pressure setting and the adjustment process will affect the unit safety, economic index, and the time for the unit to restart operation. Therefore, it is significantly important to control the high-pressure bypass mode and related methods under the load rejection conditions.

SUMMARY

To resolve the deficiencies in current technology, the present invention provides a 660MW supercritical unit high-pressure bypass control system and its control method. The system monitors the whole process of load rejection of a supercritical unit high-pressure bypass and produces the responses to high-pressure bypass control and the steam adjustment process according to the related results from monitoring the real-time unit operating situation, which makes the pressure of the whole process of bypass regulation controllable, and further makes the steam entered and circulated into the bypass meet the requirements of the unit working fluid balance. The 660MW supercritical unit bypass control system and its control method are with high safety and good reliability.

To resolve the above technical problems, the present invention adopts the following technical solutions:

A 660MW supercritical unit bypass control system comprises Pipeline 1, Pipeline 2, Pipeline 3, and Pipeline 4; the bottom of Pipeline 3, the bottom of Pipeline 2, and the head of Pipeline 4 are connected by a temperature and pressure reducer; the bottom of the Pipeline 1 is connected to the head of the Pipeline 2; a branch pipe is arranged between Pipeline 1 and Pipeline 2; a steam turbine is arranged in the branch pipe;

Between Pipeline 3 and the temperature and pressure reducer, between Pipeline 2 and the temperature and pressure reducer, and between the steam turbine and the branch pipe are controlled by valves, respectively;

Pipeline 1, Pipeline 2, Pipeline 3, Pipeline 4, the temperature and pressure reducer, the steam turbine, and the valves are regulated by the controllers, respectively.

As a preferred technical solution, Valve 1 is arranged in the branch pipe; Valve 1.1 is arranged between Valve 1 and the steam turbine; Valve 3 is arranged in Pipeline 3; Valve 3.1 is arranged between Valve 3 and the temperature and pressure reducer; Valve 2 is arranged in Pipeline 2.

As a preferred technical solution, Valve 1 is a main valve; Valve 1.1 is a main steam regulating valve; Valve 3 is a high-pressure de-superheating water isolation valve; Valve 3.1 is a high-pressure de-superheating water regulating valve; Valve 2 is a high-pressure bypass valve.

The working principle: the superheated steam flow passes Pipeline 1. It goes through Valve 1 and 1.1 to enter the high-pressure cylinder of the steam turbine to maintain the regular operation of the steam turbine. Valve 1 and Valve 1.1 close quickly during load rejection, and the superheated steam flows through Pipeline 2. Pipeline 2 and Pipeline 1 connect with a 60 degrees angle at the position 4.5 meters above the steam turbine, 5 meters on the left side of the machine head; Pipeline 2 is installed with Valve 2, which adjusted the steam flow and pressure through Pipeline 2. The adjusted steam flows through Pipeline 4 and enters the temperature and pressure reducer. Pipeline 3 and Pipeline 4 are connected through the temperature and pressure reducer at a 45 degrees angle, at 3 meters behind Valve 2; Pipeline 3 is equipped with Valve 3 and Valve 3.1. The high-pressure input water passes through Pipeline 3 from the outlet of the feedwater pump, through Valve 3, and adjusted by Valve 3.1, enters the temperature and pressure reducer to adjust the temperature of the superheated steam; the steam which passes the temperature and pressure reducer flows to a reheater through Pipeline 4. The control terminals of Valve 1, Valve 1.1, Valve 2, Valve 3, and Valve 3.1 connect to the controller, respectively. The steam pressure after load rejection is adjusted by the opening of Valve 2, and the steam temperature is adjusted by Valve 3.1 to control the steam flow matching with the actual working conditions.

The relationship of load, the regulating stage pressure, the pressure behind Valve 1.1, and the main steam flow is shown in Table 1:

| Boiler load L (%) | Regulating stage pressure $p_1$(MPa) | Electric load P (MW) | Main steam flow $f(p_1)$(t/h) |
|---|---|---|---|
| 30 | 5.8 | 198 | 600 |
| 40 | 7.5 | 264 | 750 |
| 50 | 9.43 | 330 | 1000 |
| 60 | 11.18 | 396 | 1200 |
| 70 | 12.52 | 462 | 1350 |
| 80 | 13.56 | 528 | 1500 |
| 90 | 16.8 | 594 | 1800 |
| 95 | 17.64 | 627 | 1900 |
| 100 | 18.73 | 660 | 2000 |

The control method of the 660MW supercritical nit bypass control system comprises the following steps:

the control method includes step opening control of Valve 2 during load rejection or FCB, and the opening degree of Valve 2 is:

through the steam flow calculation sheet, the bypass steam enthalpy value, and the steam balance during load rejection, the undisturbed switching of the steam channels is realized, the working fluid balance of the unit is maintained, and the overall stability of the unit is sustained;

the steam flow balance relationship is described as Equation (1):

$$Q_1=Q_2 \tag{1}$$

wherein, $Q_1$ is the steam flow (t/h) through Pipeline 1 before load rejection, and $Q_2$ is the steam flow (t/h) through Pipeline 2 after load rejection; the relationship of $Q_1$, the loading value, and the regulating stage pressure: Q1 can be obtained by calculation of the regulating stage pressure $p_1$; $f(p_1)$ is the main steam flow without temperature correction, as shown in Equation (2);

$$Q_1=f(p_1)*\sqrt{T_0/T_1} \tag{2}$$

the relationship of the value of the steam flow $Q_2$ (t/h) after the high-pressure bypass valve, the opening degree kn (%) of Valve 2, and the steam temperature $T_2$ (K) before Valve 2: since the pipelines are adjacent, $T_2$ is the same as the main steam temperature $T_1$; the steam pressure $p_2$ (MPa) before Valve 2; the steam enthalpy value E (J/kg) of passing Valve 2 can be obtained by checking $T_2$ (K) and $p_2$ (MPa); ΔP is a differential value of pressure between before and after passing Valve 2;

the flow calculation sheet according to Valve 2 has a relationship shown in Equation (2):

$$Q_2=kn*\Delta P*p_2*[507*(0.03*E(T_2,p_2)-18.7)] \tag{3}$$

when the unit is running normally, Valve 2 closes, and the steam flow enters from Valve 1 and Valve 1.1 to maintain the operation of the steam turbine; when the unit is under load rejection, Valve 1 and Valve 1.1 close instantly, and Valve 2 opens quickly;

In order to maintain the safety of the unit during load rejection, and avoid violent fluctuations of the unit, as well as maintain the working fluid balance, the opening degree of the instant step opening of Valve 2 during load rejection can be accurately calculated from the above Equations (1), (2), and (3), as shown in Equation (4):

$$kn=f(p_1)*\sqrt{T_0/T_1}/(\Delta P*p_2*[507*(0.03*E(T_1,p_2)-18.7)]) \tag{4}$$

$p_1$ (MPa) is the steam pressure after Valve 1.1, the regulating stage pressure, p2 (MPa) is the pressure before Valve V2, $T_1$(K) is the steam temperature before Valve 2, f(p1) is the main steam flow corresponding to regulating stage pressure, the steam enthalpy value E (J/kg) without temperature correction can be obtained by checking $T_1$(K) and $p_2$ (MPa), and ΔP is a differential value of pressure between before and after Valve 2;

In order to more accurately calculate the opening degree of Valve 2, a segmented polygonal function of f(p1) is performed:

When $p_1 \le 5.8, f(p_1)=600; kn=600*\sqrt{T_0/T_1}/(\Delta P*p_1*[507*(0.03*E(T_1,p_2)-18.7)])$;

When $5.8<p_1\le 7.5, f(p_1)=600+(p_1-5.8)*88.23$, $kn=(600+88.23*(p_1-5.8))*\sqrt{T_0/T_1}/(\Delta P*p_2[*507*(0.03*E(T_1,p_2)-18.7)])$;

When $7.5<p_1\le 9.43, f(p_1)=750+(p_1-7.5)*129.53$, $kn=(750+129.53*(p_1-7.5))*\sqrt{T_0/T_1}/(\Delta P*p_2*[507*(0.03*E(T_1,p_2)-18.7)])$;

When $9.43<p_1\le 11.18, f(p_1)=1000+(p_1-9.43)*114.28$, $kn=(1000+114.28*(p_1-9.43))*\sqrt{T_0/T_1}/(\Delta P*p_2*[507*(0.03*E(T_1,p_2)-18.7)])$;

When $11.18<p_1\le 12.52, f(p_1)=1233+(p_1-11.18)*111.94$, $kn=(1200+111.94*(p_1-11.18))*\sqrt{T_0/T_1}/(\Delta P*p_2*[507*(0.03*E(T_1,p_2)-18.7)])$;

When $12.52<p_1\le 13.56, f(p_1)=1350+(p_1-12.52)*144.23$, $kn=(1350+144.23*(p_1-12.52))*\sqrt{T_0/T_1}/(\Delta P*p_2*[507*(0.03*E(T_1,p_2)-18.7)])$;

When $13.56<p_1\le 16.8, f(p_1)=1500+(p_1-13.56)*133.93$, $kn=(1500+133.93*(p_1-13.56))*\sqrt{T_0/T_1}/(\Delta P*p_2*[507*(0.03*E(T_1,p_2)-18.7)])$;

When $1638<p_1\le 17.64, f(p_1)=1800+(p_1-16.8)*119.05$, $kn=(1800+119.05*(p_1-16.8))*\sqrt{T_0/T_1}/(\Delta P*p_2*[507*(0.03*E(T_1,p_2)-18.7)])$;

When $17.64<p_1\le 18.73, f(p_1)=1900+(p_1-17.64)*90.1$, $kn=(1900+90.1*(p_1-17.64))*\sqrt{T_0/T_1}/(\Delta P*p_2*[507*(0.03*E(T_1,p_2)-18.7)])$;

As a preferred technical solution, the control method still comprises the generation method of the control target pressure of Valve 2, and the setting parameter of the steam pressure control:

when the opening degree by step opening of Valve 2 reaches the calculated value according to Equation (4), the system enters the automatic control mode, automatically adjusts the main steam pressure; the steam pressure is tested when the boiler load is in the stable stage, and then the average value during the stable stage is taken as the corresponding pressure target setting parameter p4; the value of p4 is decided by the boiler load, and is a related function of the boiler load; after first-order inertia, it is used as the setting parameter of the pressure control of the high-pressure bypass valve:

$$p_4=f(L)*(1=e^{-t/20}) \tag{5}$$

t is the time in Equation (5);

The experimental data of the target pressure and boiler load s shown in the following table:

| Boiler load L (%) | Target pressure $p_4$(MPa) | Electric load P (MW) | Main steam flow $f(p_1)$(t/h) |
|---|---|---|---|
| 30 | 10.33 | 198 | 600 |
| 40 | 13.38 | 264 | 750 |
| 50 | 16.20 | 330 | 1000 |
| 60 | 18.93 | 396 | 1200 |
| 70 | 21.95 | 462 | 1350 |
| 80 | 23.81 | 528 | 1500 |
| 90 | 24 | 594 | 1800 |
| 95 | 24 | 627 | 1900 |
| 100 | 24 | 660 | 2000 |

in order to obtain more accurate target pressure, the target pressure $p_4$, which has a linear relationship to the load, is accurately piecewise calculated; the calculated value is used as the setting parameter of the target pressure when the high-pressure bypass opens during automatic control after load rejection:

When $L \leq 30, p_4 = 10.33*(1-e^{-t/20})$

When $30 < L \leq 40$, $p_4 = (10.33+0.305*(L-30))*(1-e^{-t/20})$;

When $40 < L \leq 50$, $p_4 = (13.38+0.282*(L-40))*(1-e^{-t/20})$;

When $50 < L \leq 60$, $p_4 = (16.2+0.273*(L-50))*(1-e^{-t/20})$;

When $60 < L \leq 70$, $p_4 = (18.93+0.302*(L-60))*(1-e^{-t/20})$;

When $70 < L \leq 80$, $p_4 = (21.95+0186*(L-70))*(1-e^{-t/20})$;

When $80 < L \leq 90$, $p_4 = (23.81+0.019*(L-80))*(1-e^{-t/20})$;

When $90 < L \leq 100$ $p_4 = 24$;

The deviation of the above-mentioned pressure setting value and actual steam pressure is input the PID control module of Valve 2, and the calculated output command directly controls the opening degree of the high-pressure bypass regulating valve and controls the steam pressure after load rejection or FCB corresponding to the boiler combustion load.

The present invention can achieve the following effects:

The present invention, during a boiler load rejection, through the steam flow calculation equation and the steam balance principle, uses the current steam temperature and pressure to calculate directly and accurately the opening degree of the high-pressure bypass step opening, to realize steam channels are switching accurately under any operation situation, further, to avoid the operation of the safety valve, and achieve the unit working fluid balance. Under the high-pressure bypass valve automatic control mode, according to the combustion load of the boiler, the high-pressure bypass valve control target value is automatically set, the automatic adjustment is conducted to match the bypass opening to the combustion load of the unit. Through the present invention, the high-pressure bypass control system automatically adapts to load rejection or FCB under any loading situation and avoids the drastic changes of the unit parameters from huge load fluctuations; satisfies the requirements of load rejection and FCB; meanwhile, it is of a high safety, good reliability, and a simple structure.

BRIEF DESCRIPTION OF THE DRAWINGS

As shown in FIG. 5, L1 is Pipeline 1, L2 is Pipeline 2, L3 is Pipeline 3, L4 is Pipeline 4, V1 is Valve 1, V1.1 is Valve 1.1, V2 is Valve 2, V3 is Valve 3, and V3.1 is Valve 3.1.

DETAILED DESCRIPTION OF THE EMBODIMENTS

The present invention will be further described by reference to the following drawings and examples.

Figure 1:
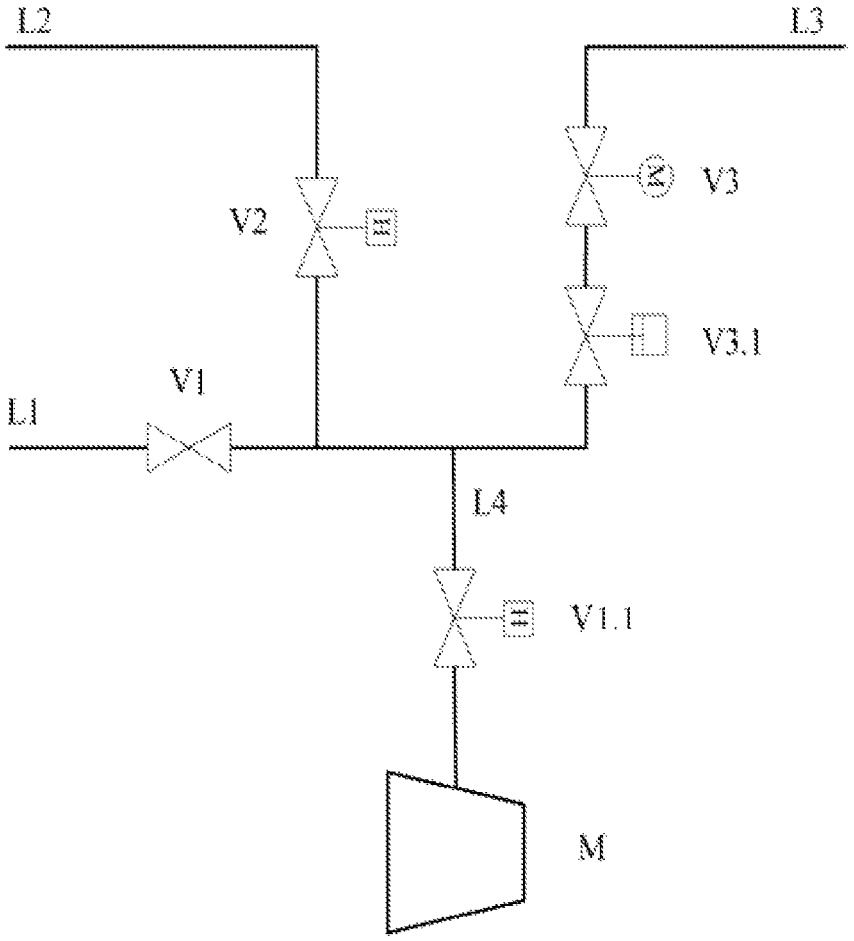
FIG. 1 is a scheme of the connection structure of the present invention.
Figure 5:
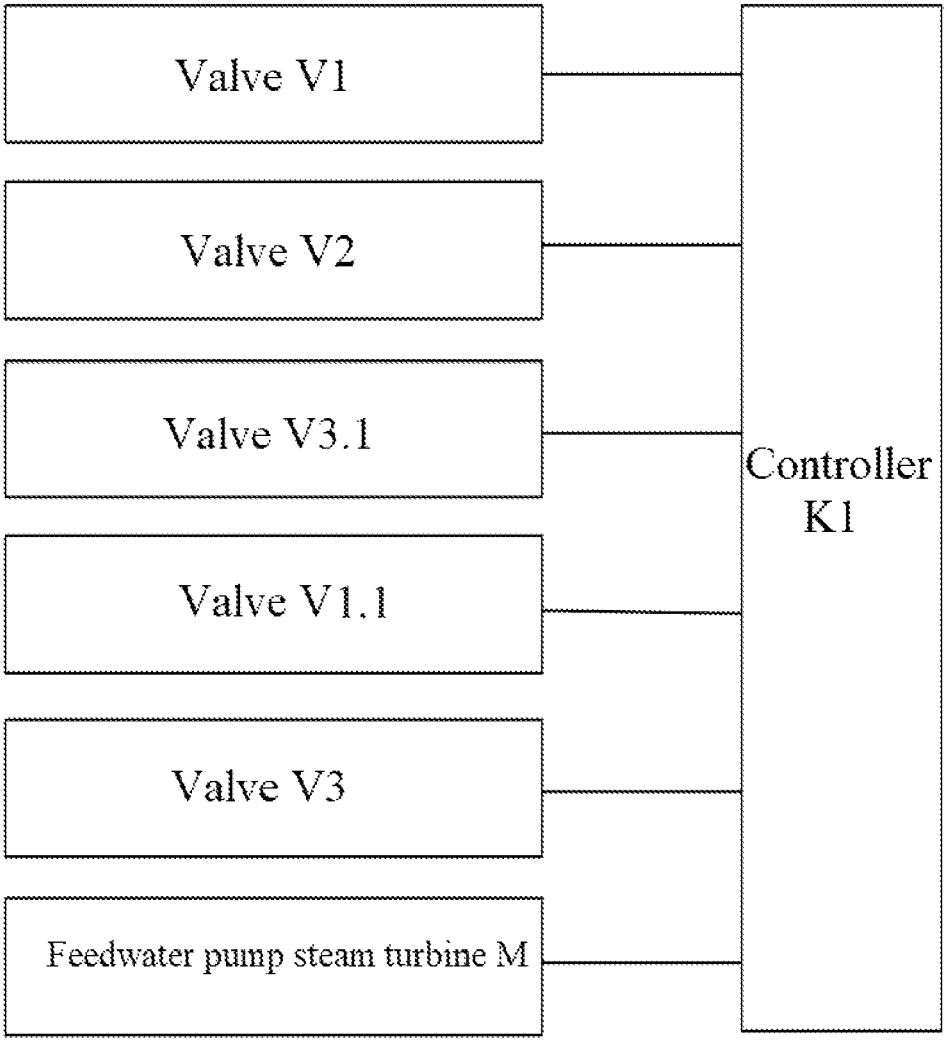
FIG. 5 is a scheme of the circuit principle connection structure of the present invention.

Example 1: A 660 MW supercritical unit bypass control system, see FIG. 1 and FIG. 5, comprises a superheater and a controller. The superheated steam flow passes Pipeline 1, through V1 and V1.1 to enter the high-pressure cylinder of the steam turbine to maintain the regular operation of the steam turbine. Valve 1 and Valve 1.1 close quickly during load rejection, and the superheated steam flows through Pipeline 2. Pipeline 2 and Pipeline 1 connect with a 60 degrees angle at the position 4.5 meters above the steam turbine, 5 meters on the left side of the machine head; Pipeline 2 is installed with Valve 2, which adjusted the steam flow and pressure in Pipeline 2. The adjusted steam flows through Pipeline 4 and enters the temperature and pressure reducer. Pipeline 3 and Pipeline 4 are connected through the temperature and pressure reducer with a 45 degrees angle, at 3 meters behind Valve 2; Pipeline 3 is equipped with Valve 3 and Valve 3.1. The high-pressure input water passes through Pipeline 3 from the outlet of the feedwater pump, through Valve 3, and is adjusted by Valve 3.1, enters the temperature and pressure reducer to adjust the temperature of the superheated steam; the steam which passes the temperature and pressure reducer flows to a reheater through Pipeline 4. The control terminals of Valve 1, Valve 1.1, Valve 2, Valve 3, and Valve 3.1 are connected to the controller, respectively. The steam pressure after load rejection is adjusted by the opening of Valve 2, and the steam temperature is adjusted by Valve 3.1 to control the steam flow matching with the actual working conditions.

The control terminals of the bypass control system Valve 1, Valve 1.1, Valve 2, Valve 3, and Valve 3.1 are connected to the controller, respectively.

Figure 2:
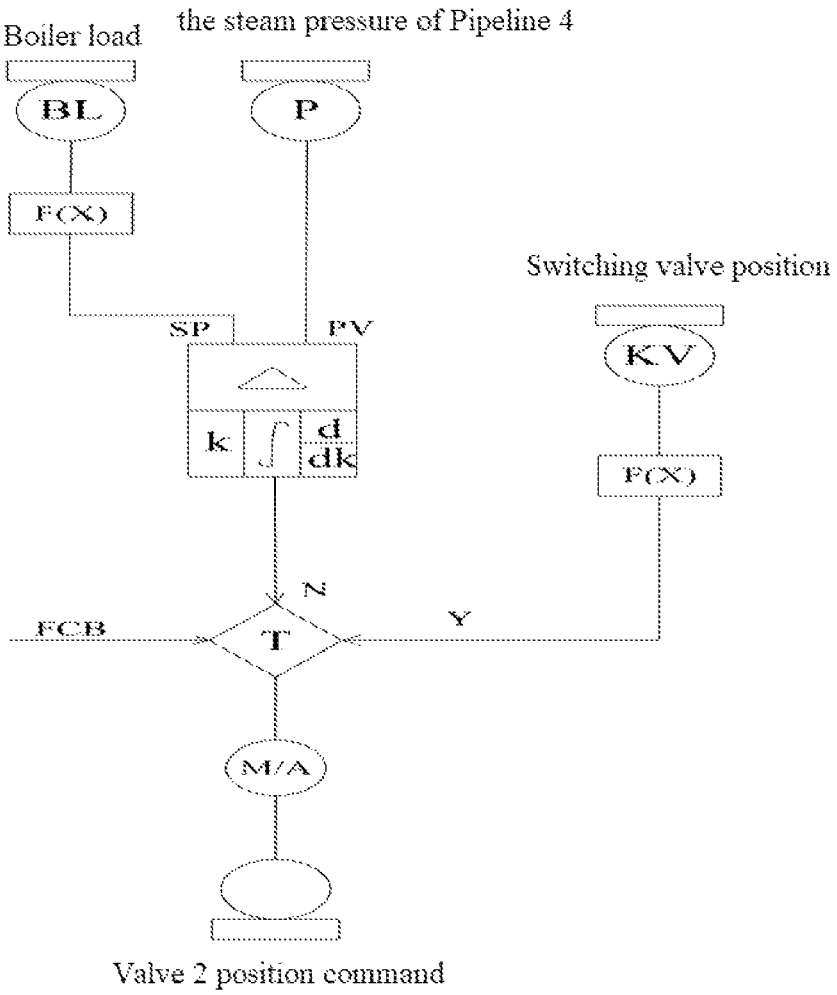
FIG. 2. is a scheme of the logical flow diagram of the high-pressure bypass control of the present invention.
Figure 3:
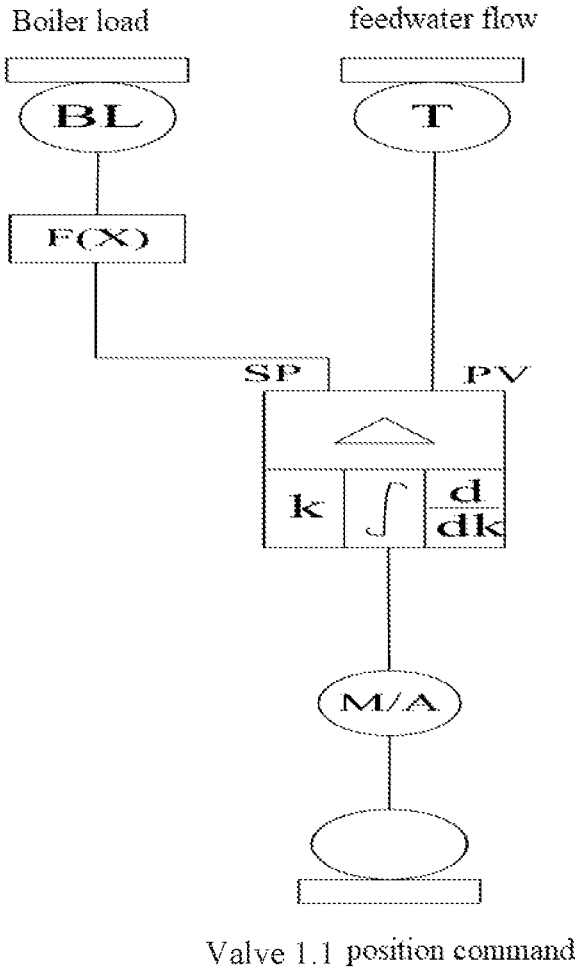
FIG. 3 is a scheme of the logical flow diagram of the low-pressure regulating valve control of the present invention.
Figure 4:
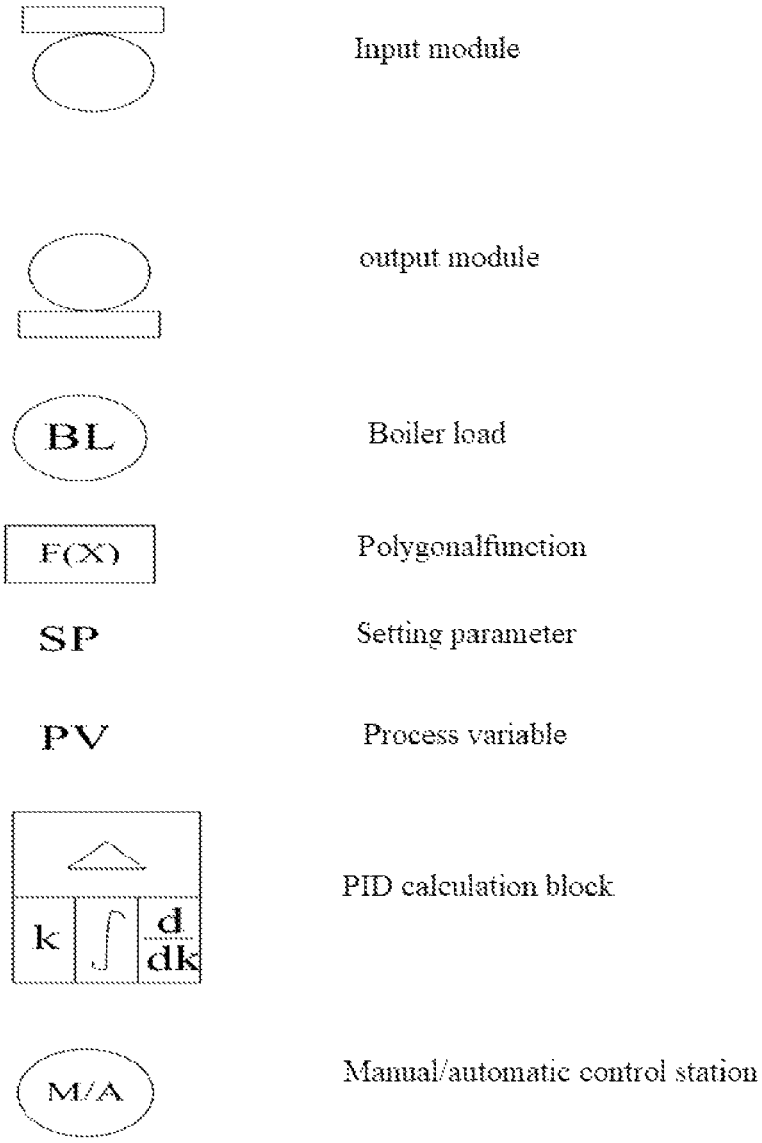
FIG. 4 is the meaning of the symbols in FIG. 2 to FIG. 3 of the present invention.

As shown in FIG. 2 and FIG. 4, a control method that applies to a bypass control system for a 660 MW supercritical unit under load rejection and FCB working conditions comprises the step opening of high-pressure bypass valve V2, the generation of the pressure setting value, and the pressure control process. The step opening degree of V2 can be obtained by accurate calculation of the steam pressure and temperature; the calculation method is stated as below:

The present invention accurately analyzes and calculates the step opening degree of V2 by integrating the steam flow calculation principle, the steam balance, and temperature and pressure parameters.

After load rejection, V1 and V1.1 close, and V2 opens. The steam flow balance relationship is described in Equation (1):

$$Q_1 = Q_2 \tag{1}$$

wherein, $Q_1$ is the steam flow (t/h) through Pipeline 1 before load rejection, and $Q_2$ is the steam flow (t/h) through Pipeline 2 after load rejection; the relationship of $Q_1$, the loading value, and the regulating stage pressure: Q1 can be obtained by calculation of the regulating stage pressure $p_1$; $f(p_1)$ is the main steam flow without temperature correction, as shown in Equation (2);

$$Q_1 = f(p_1)*\sqrt{T_0/T_1} \tag{2}$$

In Equation 2, $Q_1$ is the steam flow (the main steam flow) of Pipeline 1, To is the steam temperature under full load condition, $T_1$ is the actual steam flow, $f(p_1)$ is the function of the steam flow corresponding to different regulating stage pressure. This value has a certain linear relationship with the regulating stage pressure $P_1$.

the relationship of the value of the steam flow $Q_2$ (t/h) after Valve V2, the opening degree kn (%) of Valve 2, and the steam temperature $T_2$ (K) before Valve 2: since the pipelines are adjacent, $T_2$ is the same as the main steam temperature $T_1$; the steam pressure $p_2$ (MPa) before Valve 2; the steam enthalpy value E (J/kg) of passing Valve 2 can be obtained by checking $T_2$ (K) and $p_2$ (MPa); ΔP is a differential value of pressure between before and after passing Valve 2;

the flow calculation sheet according to Valve 2 has a relationship shown in Equation (2):

$$Q_2=kn*\Delta P*p_2*[507*(0.03*E(T_2,p_2)-1.8.7)] \quad (3)$$

when the unit is running normally, Valve 2 closes, and the steam flow enters from Valve 1 and Valve 1A to maintain the operation of the steam turbine; when the unit is under load rejection, Valve 1 and Valve 1.1 close instantly, and Valve 2 opens quickly. In order to maintain the safety of the unit during load rejection, and avoid violent fluctuations of the unit, as well as maintain the working fluid balance, the opening degree of the instant step opening of Valve 2 during load rejection can be accurately calculated from the above Equations (1), (2), and (3), as shown in Equation (4):

$$kn=f(p_1)*\sqrt{T_0/T_1}/(\Delta P*p_2*[507*(0.03*E(T_2,p_2)-18.7)]) \quad (4)$$

In order to more accurately calculate the opening degree of Valve 2, a segmented polygonal function of f(p1) is performed:

when $p_1 \le 5.8, f(p_1)=600; kn=600*\sqrt{T_0/T_1}/(\Delta P*p_2*[507*(0.03*E(T_2,p_2)-18.7)])$;

when $5.8<p_1 \le 7.5, f(p_1)=600+(p_1-5.8)*88.23$, $kn=(600+88.23*(p_1-5.8))*\sqrt{T_0/T_1}/(\Delta P*p_2*[507*(0.03*E(T_2,p_2)-18.7)])$;

when $7.5<p_1 \le 9.43, f(p_1)=750+(p_1-7.5)*129.53$, $kn=(750+129.53*(p_1-7.5))*\sqrt{T_0/T_1}/(\Delta P*p_2*[507*(0.03*E(T_2,p_2)-18.7)])$;

when $9.43<p_1 \le 11.18, f(p_1)=1000+(p_1-9.43)*114.28$, $kn=(1000+114.28*(p_1-9.43))*\sqrt{T_0/T_1}/(\Delta P*p_2*[507*(0.03*E(T_2,p_2)-18.7)])$;

when $11.18<p_1 \le 12.52, f(p_1)=1200+(p_1-11.18)*111.94$, $kn=(1200+111.94*(p_1-11.18))*\sqrt{T_0/T_1}/(\Delta P*p_2*[507*(0.03*E(T_2,p_2)-18.7)])$;

when $12.52<p_1 \le 13.56, f(p_1)=1350+(p_1-12.52)*144.23$, $kn=(1350+144.23*(p_1-12.52))*\sqrt{T_0/T_1}/(\Delta P*p_2*[507*(0.03*E(T_2,p_2)-18.7)])$;

when $13.56<p_1 \le 16.8, f(p_1)=1500+(p_1-13.56)*133.93$, $kn=(1500+133.93*(p_1-13.56))*\sqrt{T_0/T_1}/(\Delta P*p_2*[507*(0.03*E(T_2,p_2)-18.7)])$;

when $16.8<p_1 \le 17.64, f(p_1)=1800+(p_1-16.8)*119.05$, $kn=(1800+119.05*(p_1-16.8))*\sqrt{T_0/T_1}/(\Delta P*p_2*[507*(0.03*E(T_2,p_2)-18.7)])$;

when $17.64<p_1 18.73, f(p_1)=1900+(p_1-17.64)*90.1$, $kn=(1900+90.1*(p_1-17.64))*\sqrt{T_0/T_1}/(\Delta P*p_2[*507*(0.03*E(T_2,p_2)-18.7)])$;

The pressure setting value p4 controlled by V2 is a function of the boiler load L (%), with a certain linear relationship formed after the first-order inertia, when $L \le 30, p_4=10.33*(1-e^{-t/20})$ when $30<L \le 40, p_4=(10.33+0.305*(L-30))*(1-e^{-t/20})$;

when $40<L \le 50, p_4=(13.38+0.282*(L-40))*(1-e^{-t/20})$;

when $50<L \le 60, p_b=(16.2+0,273*(L-50))*(1-e^{-t/20})$;

when $60<L \le 70, p_b=(18.93+0.302*(L-60))*(1-e^{-t/20})$;

when $70<L \le 80, p_4=(21.95+0.186*(L-70))*(1-e^{-t/20})$.

when $80<L \le 90, p_4=(23.81+0.019*(L-80))*(1-e^{-t/20})$;

when $90L \le 100, p_4=24$;

After the unit is under load rejection or FCB, the V2 step opens to the opening degree kn as mentioned above: meanwhile, the steam pressure p2 is automatically adjusted to the target pressure p4 through the controller K1 to adapt to the drastic changes in the boiler load and steam pressure during load rejection, avoid overpressure and violent pressure fluctuations of the unit during load rejection or FCB, and ensure the safety of the unit.

The above examples minimize the pressure parameter fluctuation of the unit during load rejection or KB by accurately calculating the step opening degree of the high-pressure bypass valve according to the current steam pressure and temperature when the unit is load rejection or FCB. After the high-pressure bypass valve opens, the control target setting value is calculated, and the inertia session is delayed to match the actual boiler load after load rejection, which ensures the safety and stability of steam pressure control during load rejection or FCB. The bypass control method under load rejection is of high safety, good reliability, and a simple structure.

The present examples are described by reference to the drawings, which are not intended to limit the present invention when implemented. Any various changes or modifications within the scope of the appended claims may be made by an ordinary technician in the fields.

What is claimed is:

1. A 660MW supercritical unit bypass control system, comprises a Pipeline 1, a Pipeline 2, a Pipeline 3, and a Pipeline 4;

the Pipeline 1, the Pipeline 2, the Pipeline 3, and the Pipeline 4 are connected;

the Pipeline 4 is arranged between the Pipeline 1 and the Pipeline 2, and a steam turbine is arranged in the Pipeline 4;

valves for controlling are provided between the Pipeline 3 and the steam turbine, and between the Pipeline 2 and the steam turbine;

a controller configured to regulate the Pipeline 1, the Pipeline 2, the Pipeline 3, the Pipeline 4, the steam turbine, and the valves.

2. The 660MW supercritical unit bypass control system according to claim 1, wherein said valves comprising:

a Valve 1 is arranged in the Pipeline 1;

a Valve 1.1 is arranged between the Valve 1 and the steam turbine;

a Valve 3 is arranged in the Pipeline 3;

a Valve 3.1 is arranged between the Valve 3 and the steam turbine; and a Valve 2 is arranged in the Pipeline 2.

3. The 660MW supercritical unit bypass control system according to claim 2, wherein the Valve 1 is a main valve;

the Valve 1.1 is a main steam regulating valve;

the Valve 3 is a high-pressure de-superheating water isolation valve;

the Valve 3.1 is a high-pressure de-superheating water regulating valve;

the Valve 2 is a high-pressure bypass valve.

4. A control method of the 660MW supercritical unit bypass control system according to claim 3, comprising the following controlling steps via said controller:

performing an opening control of the Valve 2 during a load rejection or a fast cut back (FCB), and an opening degree of the Valve 2 is obtained as follows:

through a steam flow calculation sheet, a bypass steam enthalpy value, and a steam balance during the load rejection, an undisturbed switching of steam channels is realized, a working fluid balance of a unit is maintained, and an overall stability of the unit is sustained;

a steam flow balance relationship is described as an Equation (1), wherein the Equation (1) is as follows:

$$Q_1=Q_2 \quad (1);$$

wherein, $Q_1$ is a steam flow through the Pipeline 1 before the load rejection, and $Q_2$ is a steam flow through the Pipeline 2 after the load rejection;

a relationship of $Q_1$, a loading value, and a regulating stage pressure is shown in an Equation (2), wherein Q1 is obtained by a calculation of the regulating stage pressure $p_1$; $f(p_1)$ is a main steam flow without a temperature correction, the Equation (2) is as follows:

$$Q_1=f(p_1)*\sqrt{T_0/T_1} \quad (2)$$

a relationship of a value of the steam flow Q2 (t/h) after a high-pressure bypass valve, the opening degree kn (%) of the Valve 2, and a steam temperature $T_2$ (K) before the Valve 2 is shown in an Equation (3), wherein since the Pipeline 1, the Pipeline 2, the Pipeline 3 and Pipeline 4 are adjacent, $T_2$ is identical to a main steam temperature $T_1$;

$p_2$ (MPa) is a steam pressure before the Valve 2;

a steam enthalpy value E (J/kg) of passing the Valve 2 is obtained by checking the steam temperature $T_2$ (K) and the steam pressure $p_2$ (MPa);

ΔP is a differential value of a pressure between before and after passing the Valve 2;

the Equation (3) is as follows:

$$Q_2=kn*\Delta P*p_2*[507*(0.03*E(T_2,p_2)-1.8.7)] \quad (3)$$

when the unit is running normally, the Valve 2 closes, and the steam flow enters from the Valve 1 and the Valve 1.1 to maintain an operation of the steam turbine; when the unit is under the load rejection, the Valve 1 and the Valve 1.1 close instantly, and the Valve 2 opens quickly;

to maintain a safety of the unit during the load rejection, and avoid violent fluctuations of the unit, as well as to maintain the working fluid balance, the opening degree of an instant step opening of the Valve 2 during the load rejection is accurately calculated from the Equations (1), (2), and (3), as shown in an Equation (4), wherein the Equation (4) is as follows:

$$kn=f(p_1)*\sqrt{T_0/T_1}/(\Delta P*p_2*[507*(0.03*E(T_1,p_2)-18.7)]) \quad (4)$$

$p_1$ (MPa) is a steam pressure after the Valve 1.1, and also is the regulating stage pressure, $p_2$ (MPa) is a pressure before the Valve 2, $T_1$(K) is the steam temperature before the Valve 2, $f(p_1)$ is the main steam flow corresponding to the regulating stage pressure, the steam enthalpy value E (J/kg) without the temperature correction is obtained by checking the $T_1$ (K) and the $p_2$ (MPa), and ΔP is the differential value of the pressure between before and after the Valve 2;

in order to accurately calculate the opening degree of the Valve 2, a segmented polygonal function of $f(p_1)$ is performed:

when $p_1 \le 5.8, f(p_1)=600; kn=600*\sqrt{T_0/T_1}/(\Delta P*p_1*[507*(0.03*E(T_1,p_2)-18.7)])$;

when $5.8<p_1 \le 7.5, f(p_1)=600+(p_1-5.8)*88.23$, $kn=(600+88.23*(p_1-5.8))*\sqrt{T_0/T_1}/(\Delta P*p_2[*507*(0.03*E(T_1,p_2)-18.7)])$;

when $7.5<p_1 \le 9.43, f(p_1)=750+(p_1-7.5)*129.53$, $kn=(750+129.53*(p_1-7.5))*\sqrt{T_0/T_1}/(\Delta P*p_2*[507*(0.03*E(T_1,p_2)-18.7)])$;

when $9.43<p_1 \le 11.18, f(p_1)=1000+(p_1-9.43)*114.28$, $kn=(1000+114.28*(p_1-9.43))*\sqrt{T_0/T_1}/(\Delta P*p_2*[507*(0.03*E(T_1,p_2)-18.7)])$;

when $11.18<p_1 \le 12.52, f(p_1)=1233+(p_1-11.18)*111.94$, $kn=(1200+111.94*(p_1-11.18))*\sqrt{T_0/T_1}/(\Delta P*p_2*[507*(0.03*E(T_1,p_2)-18.7)])$;

when $12.52<p_1 \le 13.56, f(p_1)=1350+(p_1-12.52)*144.23$, $kn=(1350+144.23*(p_1-12.52))*\sqrt{T_0/T_1}/(\Delta P*p_2*[507*(0.03*E(T_1,p_2)-18.7)])$;

when $13.56<p_1 \le 16.8, f(p_1)=1500+(p_1-13.56)*133.93$, $kn=(1500+133.93*(p_1-13.56))*\sqrt{T_0/T_1}/(\Delta P*p_2*[507*(0.03*E(T_1,p_2)-18.7)])$;

when $16.8<p_1 \le 17.64, f(p_1)=1800+(p_1-16.8)*119.05$, $kn=(1800+119.05*(p_1-16.8))*\sqrt{T_0/T_1}/(\Delta P*p_2*[507*(0.03*E(T_1,p_2)-18.7)])$;

when $17.64<p_1 \le 18.73, f(p_1)=1900+(p_1-17.64)*90.1$, $kn=(1900+90.1*(p_1-17.64))*\sqrt{T_0/T_1}/(\Delta P*p_2*[507*(0.03*E(T_1,p_2)-18.7)])$.

5. The control method of the 660MW supercritical unit bypass control system according to claim 4, wherein, the control method comprises a generation method of a control target pressure of the Valve 2 and a setting parameter of a steam pressure control is obtained as follows:

when the opening degree by the instant step opening of the Valve 2 reaches a calculated value according to the Equation (4), the 660MW supercritical unit bypass control system enters an automatic control mode, automatically adjusts a main steam pressure;

the main steam pressure is tested when a boiler load is in a stable stage, and then an average value during the stable stage is taken as a corresponding pressure target setting parameter $p_4$;

a value of the corresponding pressure target setting parameter $p_4$ is decided by the boiler load, and f(L) is a related function of the boiler load;

after a first-order inertia, the corresponding pressure target setting parameter $p_4$ used as the setting parameter of the steam pressure control of the high-pressure bypass valve, as shown in an Equation (5):

$$p_4=f(L)*(1=e^{-t/20}) \quad (5);$$

t is a time in Equation (5);

the corresponding pressure target setting parameter $p_4$ has a linear relationship to a load, and is accurately piecewise calculated as follows to obtain an accurate target pressure, wherein a calculated value is used as the corresponding pressure target setting parameter of the target pressure when the high-pressure bypass valve opens during the automatic control mode after the load rejection:

when $L\leq 30, p_4=10.33*(1-e^{-t/20})$ when $30<L\leq 40, p_4=(10.33+0.305*(L-30))*(1-e^{-t/20})$;

when $40<L\leq 50, p_4=(13.38+0.282*(L-40))*(1-e^{-t/20})$;

when $50<L\leq 60, p_4=(16.2+0.273*(L-50))*(1-e^{-t/20})$;

when $60<L\leq 70, p_4=(18.93+0.302*(L-60))*(1-e^{-t/20})$;

when $70<L\leq 80, p_4=(21.95+0186*(L-70))*(1-e^{-t/20})$;

when $80<L\leq 90, p_4=(23.81+0.019*(L-80))*(1e^{-t/20})$;

when $90<L\leq 100\ p^4=24$;

a value of the steam pressure $P_4$ (MPa) of the Pipeline 4 at an inlet of the steam turbine has a linear relationship with the boiler load L, a piecewise function calculation is developed as follows to obtain an accurate steam pressure value of the Pipeline 4, wherein the calculated value is used as a steam pressure setting parameter of the Pipeline 4 during a corresponding boiler load; a setting value is used as the steam pressure setting parameter of a Proportion Integration Differentiation (PID) control module after the Valve 2 piecewise opens;

when $L\leq 30, P_4=0.58$;

when $30<L\leq 40, P_4=0.58+(L-30)*0.006$;

when $40<L\leq 50, P_4=0.62+(L-40)*0.006$;

when $50<L\leq 60, P_4=0.68+(L-50)*0.008$;

when $60<L\leq 70, P_4=0.76+(L-60)*0.011$;

when $70<L\leq 80, P_4=0.87+(L-70)*0.013$;

when $80<L\leq 90, P_4=1.00+(L-80)*0.012$;

when $90<L\leq 95, P_4=1.12+(L-90)*0.022$;

when $95<L\leq 100, P_4=1.23+(L-95)*0.022$;

when $L>100, P_4=1.23$;

a deviation of a pressure setting value and an actual steam pressure is input the PID control module of the Valve 2, and a calculated output command directly controls the opening degree of the high-pressure bypass valve and controls the actual steam pressure after the load rejection or the FCB corresponding to the boiler load.

* * * * *